US007669726B2

(12) United States Patent
Sun

(10) Patent No.: US 7,669,726 B2
(45) Date of Patent: Mar. 2, 2010

(54) BEVERAGE CONTAINER AND A METHOD OF USING SAME

(75) Inventor: Kai Ming Andrew Sun, Hong Kong (CN)

(73) Assignee: Kin Hip Metal & Plastic Factory Ltd., kwun Tong (CN)

( * ) Notice: Subject to any disclaimer, the term of this patent is extended or adjusted under 35 U.S.C. 154(b) by 432 days.

(21) Appl. No.: 10/589,650

(22) PCT Filed: Feb. 27, 2004

(86) PCT No.: PCT/CN2004/000150

§ 371 (c)(1),
(2), (4) Date: Sep. 7, 2006

(87) PCT Pub. No.: WO2005/082746

PCT Pub. Date: Sep. 9, 2005

(65) Prior Publication Data

US 2008/0164266 A1 Jul. 10, 2008

(51) Int. Cl.

| | |
|---|---|
| ***B65D 25/04*** | (2006.01) |
| ***B65D 88/74*** | (2006.01) |
| *B65D 1/04* | (2006.01) |
| *B65D 21/02* | (2006.01) |

(52) U.S. Cl. ..... 220/23.89; 220/521; 220/528; 220/592.16

(58) Field of Classification Search ..... 220/521, 220/522, 592.16, 592.17, 23.89, 592.15, 220/528; 215/6

See application file for complete search history.

(56) References Cited

U.S. PATENT DOCUMENTS

| | | | | | |
|---|---|---|---|---|---|
| 205,486 | A | * | 7/1878 | Johnson | 220/592.01 |
| 832,556 | A | * | 10/1906 | Oviatt | 210/181 |
| 1,030,325 | A | * | 6/1912 | Peoples et al. | 220/521 |
| 1,033,009 | A | * | 7/1912 | Hall | 220/527 |
| 1,047,681 | A | * | 12/1912 | Moffat | 141/381 |
| 1,954,370 | A | * | 4/1934 | Solomon | 222/130 |
| 4,618,444 | A | * | 10/1986 | Hudson et al. | 8/111 |
| 4,720,351 | A | * | 1/1988 | Flynn et al. | 510/277 |
| 5,435,256 | A | * | 7/1995 | Svehaug | 109/65 |
| 5,472,274 | A | | 12/1995 | Baillie | |

(Continued)

FOREIGN PATENT DOCUMENTS

| | | | |
|---|---|---|---|
| CN | 2128715 | Y | 7/1992 |

(Continued)

*Primary Examiner*—Anthony Stashick
*Assistant Examiner*—Niki M Eloshway
(74) *Attorney, Agent, or Firm*—Sheehan Phinney Bass & Green P.A.; Peter A. Nieves

(57) ABSTRACT

A beverage container (10) is disclosed as including a body (12) with a top end and a cooling device (20) detachably engageable with the body (12), in which the body (12) is adapted to hold a beverage, and the cooling device (20) is adapted to contain a cooling agent, e.g. water and when the cooling device (20) is engaged with the body (12), at least a major portion of the top end of the body (12) is closed and at least part of the cooling device (20) extends into an interior cavity of the body (12), and the cooling device (20) includes a vessel (22) and a top (24) removably engageable with each other. A method of using such a beverage container is also disclosed.

9 Claims, 2 Drawing Sheets

U.S. PATENT DOCUMENTS

| | | | | |
|---|---|---|---|---|
| 5,502,981 | A * | 4/1996 | Sullivan | 62/372 |
| 5,732,567 | A | 3/1998 | Anderson | |
| 6,332,557 | B1 * | 12/2001 | Moran | 220/592.16 |
| 6,390,319 | B1 * | 5/2002 | Yu | 220/230 |
| 2007/0051689 | A1 * | 3/2007 | Anderson | 215/228 |

FOREIGN PATENT DOCUMENTS

| | | |
|---|---|---|
| CN | 2256686 Y | 12/1995 |
| CN | 2303541 Y | 7/1997 |
| CN | 1401548 A | 8/2001 |
| EP | 1285882 A1 | 2/2003 |

* cited by examiner

BEVERAGE CONTAINER AND A METHOD OF USING SAME

This invention relates to a beverage container, in particular such a container with a detachable cooling member, and a method of using such a container.

BACKGROUND OF THE INVENTION

There are in existence a number of pitchers with detachable chiller device. For example, U.S. Pat. No. 5,732,567 issued to Anderson discloses a chiller device for a pitcher which holds a beverage. The chiller comprises a sealed container with a freezable coolant, and a structure for maintaining the sealed container within the body of the pitcher. A major disadvantage associated with this prior art chiller device is that the open top end of the pitcher is not covered. The chilling effect of the chiller device will therefore be compromised as the beverage held by the pitcher is exposed to the outside environment.

U.S. Pat. No. 5,472,274 issued to Baillie discloses a container for cooling and stirring a beverage. The container includes a pitcher for receiving the beverage and a lid detachably coupled to a top end of the pitcher. A cooling cylinder assembly for receiving ice cubes is mounted to a bottom surface of the lid and extends into contact with the beverage, thus cooling the beverage in the container. A shortcoming associated with this prior art container is that once the ice cubes have melted into liquid water, the water has to be poured out from the cooling cylinder assembly, and new ice cubes introduced into the cooling cylinder assembly. Such is a cumbersome operation.

Other prior art beverage containers include China Patent for Utility Model Nos. ZL 92217483.0 published under No. CN 2128715Y, ZL 97221836.X published under No. CN 2303541Y and ZL 95246684.8 published under No. CN 2256686Y.

It is an object of the present invention to provide a beverage container with a cooling member in which the aforesaid shortcomings are mitigated, or at least to provide a useful alternative to the public.

It is a further object of the present invention to provide a method of using such a beverage container.

SUMMARY OF THE INVENTION

According to a first aspect of the present invention, there is provided a beverage container including a body member with a top end and a cooling member detachably engageable with said body member, wherein said body member is adapted to hold a beverage, wherein said cooling member is adapted to contain a cooling agent, wherein when said cooling member is engaged with said body member, at least a major portion of said top end of said body member is closed and at least part of said cooling member extends into an interior cavity of said body member, and wherein said cooling member includes a vessel member and a closure member removably engageable with each other.

According to a second aspect of the present invention, there is provided a method of using a beverage container, including the steps of (a) providing a body member with a top end, said body member being adapted to hold a beverage, (b) providing a cooling member detachably engageable with said body member, said cooling member being adapted to contain a coolable agent and including a vessel member and a closure member removably engageable with each other, wherein when said cooling member is engaged with said body member, at least a major portion of said top end of said body member is closed and at least part of said cooling member extends into an interior cavity of said body member, (c) introducing said coolable agent into a cavity of said cooling member, (d) cooling the cooling member to below the ambient temperature, and (e) engaging said cooling member with said body member.

BRIEF DESCRIPTION OF THE DRAWINGS

An embodiment of the present invention will now be described, by way of example only, with reference to the accompanying drawings, in which.

DETAILED DESCRIPTION OF AN EMBODIMENT OF THE INVENTION

Figure 1:
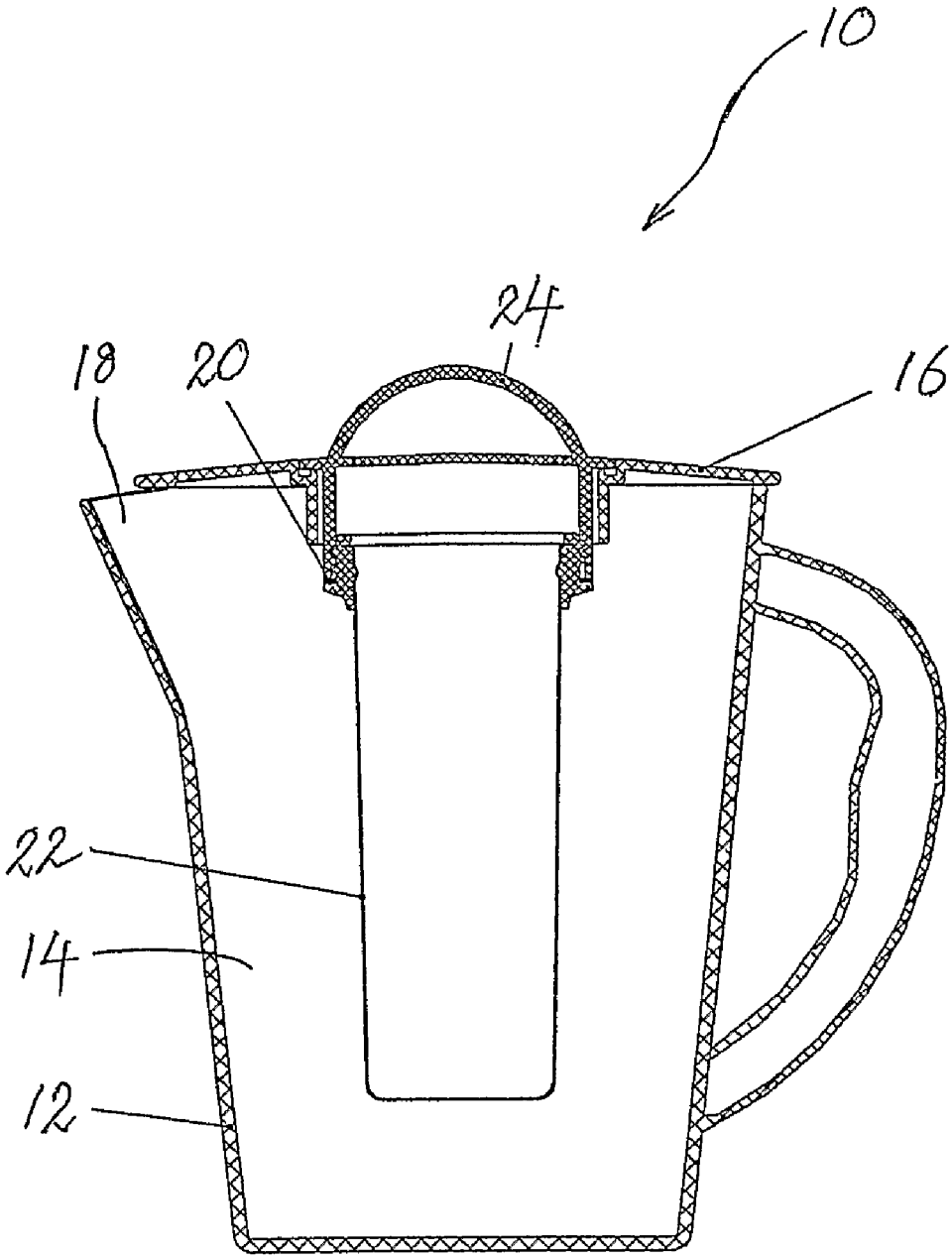
FIG. 1 is a cross-sectional view of a pitcher according to the present invention.
Figure 4:
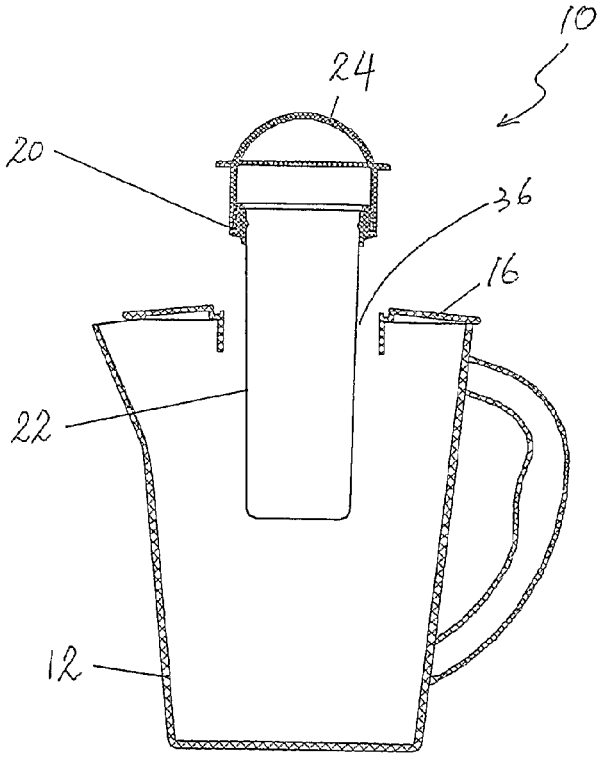
FIG. 4 is a cross-sectional view of the pitcher shown in FIG. 1, in which the cooling device is shown as being detached from the body of the pitcher.

A cross-sectional view of a pitcher according to the present invention is shown in FIGS. 1 and 4, and generally designated as 10. The pitcher 10 includes a body 12 with an interior cavity 14 for containing a beverage, e.g. water, or fruit juice. A top end of the body 12 is partly closed by a lid 16, leaving a spout 18 via which the content in the body 12 may be poured out. The pitcher 10 also includes a cooling device 20 for holding a coolable agent, e.g. water or saline water. The cooling device 20 comprises a metal, e.g. stainless steel, vessel 22 and a top 24. It can be seen that, when the cooling device 20 is engaged with the body 12, as shown in FIG. 1, a major portion of the top end of the body 12 is closed, and a major portion of the cooling device 20, in particular the entire vessel 22, extends into the interior cavity 14 of the body 12. As shown in FIG. 4, the cooling device 20 is detachably engageable with the body 12. In particular, the cooling device 20 may be inserted into the interior cavity 14 of the body 12 via a central opening 36 of the lid 16.

Figure 2:
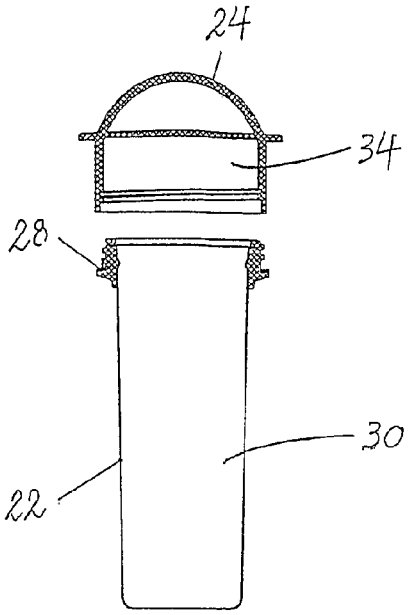
FIG. 2 is a cross-sectional view of a cooling device in the pitcher shown in FIG. 1, in a detached configuration.
Figure 3:
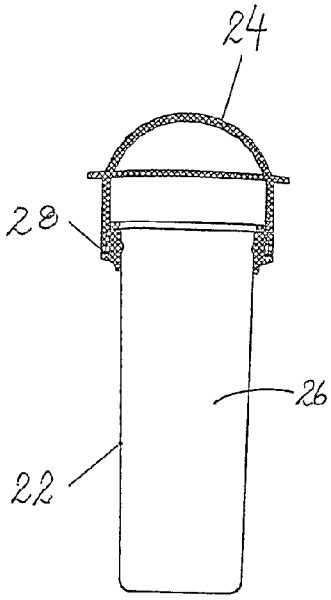
FIG. 3 is a cross-sectional view of the cooling device shown in FIG. 2, in an engaged configuration.

Turning now to FIGS. 2 and 3, the metal vessel 22 and the top 24 are threadedly engageable with each other to form an internal cavity 26 for containing the coolable agent. It can be seen that a sealing ring 28 is provided on the outside surface of an upper end of the vessel 22 for ensuring sealing engagement between the vessel 22 and the top 24, so that when the cooling device 20 is engaged with the body 12, the content in the interior cavity 14 is sealed against the content in the internal cavity 26 of the vessel 22. It is of course possible to provide the sealing ring in the top 24.

It can be seen that the volume of the internal cavity 26 formed when the metal vessel 22 and the top 24 are threadedly engaged with each other is larger than the volume of cavity 30 of the vessel 22. Such is an important feature as water may be poured into the vessel 22 to the fullest possible extent without fear of breaking the vessel 22 when water is being frozen, since the frozen water may expand into a cavity 34 of the top 24.

In use, coolable agent, e.g. water or saline water, is introduced into the internal cavity 26 of the vessel 22 of the cooling device 20. The cooling device 20 is then placed into a refrigerating apparatus, e.g. a refrigerator, for cooling. When the water is cooled to below the ambient temperature, e.g. 0° C., the cooling device 20 may then be retrieved from the refrigerator and engaged with the body 12. The content held by the body 12 may then be cooled by the cooling device 20.

A container 10 according to the present invention may be provided with more than one cooling device 20. All such cooling devices may be placed in a refrigerator. When a first cooling device 20 is engaged with the body 12 and the temperature of the cooling agent in this first cooling device 20 rises back to or close to the ambient temperature, this cooling device 20 may be detached from the body 12, and a second cooling device 20 retrieved from the refrigerator for engagement with the body 12. The first cooling device may then be re-placed into the refrigerator for cooling. This provides a very convenient and easy way of keeping the content in the body 12 at a temperature below the ambient temperature, and keeping cooling devices ready for use.

It should be understood that the above only illustrates an example whereby the present invention may be carried out, and that various modifications and/or alterations may be made thereto without departing from the spirit of the invention. It should also be understood that certain features of the invention which are, for brevity, described here in the context of a single embodiment, may be provided separately or in any appropriate sub-combinations.

The invention claimed is:

1. A beverage container including a body member with a top end, said top end having an opening therein; and a cooling member detachably engageable with said body member, said cooling member includes a vessel member and a top closure member, said vessel member has a vessel member cavity therein and said top closure member has a top closure cavity therein, said vessel member and said top closure member being threadedly engageable with each other such that an outer surface of said vessel member is directly engaged with an inner surface of said top closure member;

wherein when said top closure member is threadedly engaged on the vessel member, the vessel member and top closure member form an enclosed internal cavity, such that the volume of said enclosed internal cavity is larger than the volume of said vessel member cavity to thereby allow a coolable agent in said vessel to expand into the top closure cavity of said top closure member upon freezing;

wherein the cooling member, including the vessel member threadedly engaged with the top closure member, is removably seated in the opening of the top end of the body member such that an outer surface of the top closure member engages a radially inwardly facing surface of the top end;

wherein when said cooling member is engaged with said body member, the cooling member extends through the opening of said top end of the body member, at least a major portion of said top end of said body member is closed and at least part of said cooling member extends into an interior cavity of said body member; and wherein said body member is adapted to hold a beverage and said cooling member is adapted to contain a cooling agent.

2. A beverage container according to claim 1 wherein either one of the vessel member or the closure member includes a sealing ring.

3. A beverage container according to claim 2 wherein said vessel member includes said sealing ring.

4. A beverage container according to claim 1 wherein said vessel member is made of a metal.

5. A method of using a beverage container, including the steps of:

(a) providing a body member with a top end, said top end having an opening therein and said body member being adapted to hold a beverage;

(b) providing a cooling member detachably engageable with said body member, said cooling member includes a vessel member and a top closure member, said vessel member has a vessel member cavity therein and said top closure member has a top closure cavity therein, said vessel member and said top closure member being threadedly engageable with each other such that an outer surface of said vessel member is directly engaged with an inner surface of said top closure member, said cooling member being adapted to contain a coolable agent;

wherein when said top closure member is threadedly engaged on the vessel member, the vessel member and top closure member form an enclosed internal cavity, such that the volume of said enclosed internal cavity is larger than the volume of said vessel member cavity to thereby allow a coolable agent in said vessel to expand into the top closure cavity of said top closure member upon freezing;

wherein the cooling member, including the vessel member threadedly engaged with the top closure member, is removably seated in the opening of the top end of the body member such that an outer surface of the top closure member engages a radially inwardly facing surface of the top end;

wherein when said cooling member is engaged with said body member, the cooling member extends through the opening of said top end of the body member, at least a major portion of said top end of said body member is closed and at least part of said cooling member extends into an interior cavity of said body member; and (c) introducing said coolable agent into a cavity of said cooling member;

(d) placing said cooling member into a refrigerating apparatus;

(e) retrieving said cooling member from said refrigerating apparatus after said coolable agent is cooled to below the ambient temperature; and (f) engaging said cooling member with said body member.

6. A method according to claim 5 wherein said coolable agent is water.

7. A method according to claim 5 further including a step of providing either one of the vessel member or the closure member with a sealing ring.

8. A method according to claim 7 further including a step of providing said vessel member with said sealing ring.

9. A method according to claim 5 wherein said vessel member is made of a metal.

* * * * *